US011480020B1

(12) United States Patent
Russell et al.

(10) Patent No.: US 11,480,020 B1
(45) Date of Patent: Oct. 25, 2022

(54) DOWNHOLE TOOL ACTIVATION AND DEACTIVATION SYSTEM

(71) Applicant: Arrival Oil Tools, Inc., Leduc (CA)

(72) Inventors: Jayson Russell, Calgary (CA); Laurier E. Comeau, Calgary (CA)

(73) Assignee: Arrival Energy Solutions Inc., Leduc (CA)

( * ) Notice: Subject to any disclaimer, the term of this patent is extended or adjusted under 35 U.S.C. 154(b) by 0 days.

(21) Appl. No.: 17/302,457

(22) Filed: May 3, 2021

(51) Int. Cl.
*E21B 23/04* (2006.01)
*E21B 23/14* (2006.01)
*E21B 28/00* (2006.01)

(52) U.S. Cl.
CPC ..... *E21B 23/0413* (2020.05); *E21B 23/14* (2013.01); *E21B 28/00* (2013.01)

(58) Field of Classification Search
CPC ... E21B 4/02; E21B 7/24; E21B 23/02; E21B 23/04; E21B 23/0413; E21B 23/08; E21B 28/00; E21B 31/005; E21B 33/12; E21B 34/06; E21B 34/14; E21B 34/142; E21B 34/16; E21B 41/0078
See application file for complete search history.

(56) References Cited

U.S. PATENT DOCUMENTS 3,465,820 A 9/1969 Kisling
3,554,281 A * 1/1971 Ecuer ..... E21B 43/14 166/325
3,964,556 A 6/1976 Gearhart et al.
4,064,937 A 12/1977 Barrington
4,252,196 A * 2/1981 Silberman ..... E21B 43/10 166/322
4,630,244 A 12/1986 Larronde
4,967,844 A 11/1990 Brooks et al.
5,730,249 A 3/1998 Shimizu
5,890,537 A 4/1999 Lavaure et al.
6,279,670 B1 8/2001 Eddison et al.
6,675,607 B2 1/2004 Tarutani et al.
6,866,104 B2 * 3/2005 Stoesz ..... E21B 31/005 173/90
7,874,382 B2 1/2011 Püttmann et al.
(Continued)

FOREIGN PATENT DOCUMENTS

WO WO-2021016282 A1 * 1/2021 ..... E21B 28/00

OTHER PUBLICATIONS

Blackhawk Specialty Tools, "Brute 2 Storm Valve," http://blackhawkst.com/tools/brute-2-storm-valve/, last visited Jan. 31, 2019, 4 pages.
(Continued)

*Primary Examiner* — Jennifer H Gay
(74) *Attorney, Agent, or Firm* — Schafer IP Law

(57) ABSTRACT

A system provides for the remote activation and deactivation of a downhole tool such as an agitator tool. The downhole tool uses a dart-catching section configured with a profile that engages with a corresponding key section of a dart. Different tools in the string may have different profiles, allowing darts to pass through tools to reach a tool with a matching profile further downhole. The dart includes a removable nozzle that can be detached by a object dropped from the surface, after which a second dart may be dropped to engage with the first dart to change operating parameters of the tool.

15 Claims, 18 Drawing Sheets

(56) References Cited

U.S. PATENT DOCUMENTS

| | | | | |
|---|---|---|---|---|
| 8,167,051 | B2 | 5/2012 | Eddison et al. | |
| 8,327,945 | B2 | 12/2012 | Gette et al. | |
| 8,544,567 | B2 | 10/2013 | Comeau et al. | |
| 8,567,528 | B2 | 10/2013 | Comeau et al. | |
| 8,826,987 | B2 | 9/2014 | Watson et al. | |
| 9,598,923 | B2 * | 3/2017 | Gilleylen | E21B 28/00 |
| 9,624,728 | B2 | 4/2017 | Crowley et al. | |
| 10,502,018 | B2 * | 12/2019 | Provost | E21B 34/14 |
| 10,989,004 | B2 * | 4/2021 | Russell | E21B 34/142 |
| 2007/0261862 | A1 * | 11/2007 | Murray | E21B 34/14 166/386 |
| 2012/0193145 | A1 | 8/2012 | Anderson | |
| 2012/0227980 | A1 * | 9/2012 | Fay | E21B 34/14 166/373 |
| 2014/0090888 | A1 | 4/2014 | Smith et al. | |
| 2014/0151068 | A1 * | 6/2014 | Gilleylen | E21B 28/00 166/381 |
| 2014/0190749 | A1 | 7/2014 | Lorenson et al. | |
| 2016/0032653 | A1 | 2/2016 | James et al. | |
| 2016/0251923 | A1 | 9/2016 | Keerthivasan et al. | |
| 2016/0281449 | A1 | 9/2016 | Lorenson et al. | |
| 2016/0298422 | A1 * | 10/2016 | Hyde, Jr. | E21B 43/14 |
| 2017/0175469 | A1 * | 6/2017 | Murphy | E21B 23/03 |
| 2018/0051518 | A1 | 2/2018 | Tonti et al. | |
| 2018/0163486 | A1 * | 6/2018 | Davies | E21B 23/01 |
| 2018/0163495 | A1 * | 6/2018 | Kinsella | E21B 28/00 |
| 2018/0171719 | A1 | 6/2018 | Donald et al. | |
| 2018/0230750 | A1 * | 8/2018 | Lorenson | E21B 21/103 |
| 2018/0340388 | A1 * | 11/2018 | Lorenson | E21B 4/02 |
| 2019/0032444 | A1 * | 1/2019 | Provost | H02K 41/02 |
| 2019/0153820 | A1 | 5/2019 | Lorenson et al. | |
| 2020/0270960 | A1 | 8/2020 | Watkins et al. | |
| 2020/0355054 | A1 * | 11/2020 | Fripp | E21B 47/06 |
| 2021/0040808 | A1 * | 2/2021 | Russell | E21B 34/142 |

OTHER PUBLICATIONS

Challenger Downhole Tools, "Challenger Sidewinder," http://challengerdownhole.com/downhole-tool-products/challenger-sidewinder/, last visited Apr. 19, 2019, 3 pages.

CT Energy Services Ltd., "SRD Ratler Series," https://www.ctenergyservices.com/products/srd-ratler-series/, last visited Apr. 19, 2019, 4 pages.

Drilformance, "Accelglide," Aug. 7, 2016, 1 page.

DrillingFormulas.Com, "What are differences between Full Opening Safety Valve (TIW valve) and Inside BOP valve (Gray Valve)?," http://www.drillingformulas.com/what-are-differences-between-full-opening-safety-valve-tiw-valve-and-inside-bop-valve-gray-valve/, Nov. 9, 2013, 20 pages.

Impulse Downhole Tools, "Friction Reduction," https://www.impulsedownhole.com/new-page, last visited Apr. 19, 2019, 3 pages.

National Oilwell Varco, "Agitator Systems," https://www.nov.com/agitator/, last visited Apr. 19, 2019, 9 pages.

USPTO, Non-Final Office Action in U.S. Appl. No. 16/534,888, 10 pages, dated Dec. 1, 2020.

* cited by examiner

DOWNHOLE TOOL ACTIVATION AND DEACTIVATION SYSTEM

TECHNICAL FIELD

The present invention relates to the field of directional drilling, and in particular to a system for activating and deactivating tools for use in downhole drilling operations.

BACKGROUND ART

Directional drilling involves controlling the direction of a wellbore as it is being drilled. Directional drilling typically utilizes a combination of three basic techniques, each of which presents its own special features. First, the entire drill string may be rotated from the surface, which in turn rotates a drilling bit connected to the end of the drill string. This technique, sometimes called "rotary drilling," is commonly used in non-directional drilling and in directional drilling where no change in direction during the drilling process is required or intended. Second, the drill bit may be rotated by a downhole motor that is powered, for example, by the circulation of fluid supplied from the surface. This technique, sometimes called "slide drilling," is typically used in directional drilling to effect a change in direction of a wellbore, such as in the building of an angle of deflection, and almost always involves the use of specialized equipment in addition to the downhole drilling motor. Third, rotation of the drill string may be superimposed upon rotation of the drilling bit by the downhole motor. Additionally, a new method of directional drilling has emerged which provides steering capability while rotating the drill string, referred to as a rotary steerable system.

When drilling deep boreholes in the earth, sections of the borehole can cause drag or excess friction which may hinder weight transfer to the drill bit, or cause erratic torque in the drill string. Frictional engagement of the drill string and the surrounding formation can reduce the rate of penetration of the drill bit, increase the necessary weight-on-bit, and lead to stick-slip. These effects may have the result of slowing down the rate of penetration, creating borehole deviation issues, or even damaging drill string components. These problems exist in all drilling methods including rotary drilling and when using a rotary steerable system. However, they are particularly pronounced while slide drilling where significant friction results from the lack of rotation of the drill string.

Friction tools are often used to overcome these problems by vibrating a portion of the drill string to mitigate the effect of friction or hole drag. These friction tools form part of the downhole assembly of the drill string and can be driven by the variations in the pressure of drilling fluid (which may be air or liquid, such as drilling mud) flowing through the friction tool. Accordingly, the operation or effectiveness of a friction tool—namely, the frequency and amplitude of vibrations generated by the friction tool—may be affected by the flow rate of drilling fluid pumped through the string. Controlling the vibrations thus may involve varying the flow rate of the drilling fluid at the surface and to cease operation of the friction tool the flow of drilling fluid must be cut off at the surface. Varying or cutting off the drilling fluid flow, however, will impact the operation of the entire drill string.

Furthermore, running a friction tool during the entirety of a drilling operation is not always desirable. For instance, it may be unnecessary or undesirable to run the tool while the drill bit is at a shallow depth, within casing or cement, or at other stages of the drilling operation where the added vibration of the friction tool is problematic. During those stages, the drill string may be assembled without the friction tool. However, when a location in the borehole is reached where the need for a friction tool is evident, pulling the downhole assembly to the surface to reassemble the drill string to include the friction tool and then returning the drill string to the drill point can consume several very expensive work hours.

SUMMARY OF INVENTION

A first general aspect provides a downhole tool for inclusion in a drill string, including a dart-catching section disposed on an uphole end of the downhole tool. wherein the dart catching section includes a guide section forming a guide for receiving a dart when dropped from uphole, and a keyed profile, configured to engage with a corresponding key section of the dart, catching the dart, and configured to allow darts having a different key section to pass through the downhole tool. The downhole tool further includes a power section, coupled to the dart catching section, configured to power the downhole tool when activated by catching the dart in the dart catching section.

A second general aspect provides a dart for use downhole that includes a key section disposed on an outer surface of the dart, the key section including a sequence of keys for engaging a corresponding keyed profile on an inner surface of a downhole tool, a dart body, open for fluid flow through the dart, a nozzle retainer affixed in a bore of the dart body, wherein the nozzle retainer is separable from the dart body upon engagement with an object dropped downhole, a dart nozzle attached to the nozzle retainer configured for a predetermined amount of fluid flow diversion, and a basket section having openings for fluid flow through the dart, coupled to the dart body, wherein the basket section retains the nozzle retainer and dart nozzle upon separation of nozzle retainer from the dart body.

A third general aspect is a method of controlling a first downhole tool that includes flowing drilling fluid through a bore of the first downhole tool, pumping downhole a first dart, engaging a key section of the first dart with a corresponding keyed profile of a dart catching section of the first downhole tool, diverting drilling fluid flow from the bore by a nozzle of the first dart, and activating a power section of the first downhole tool responsive to diverting drilling fluid flow.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
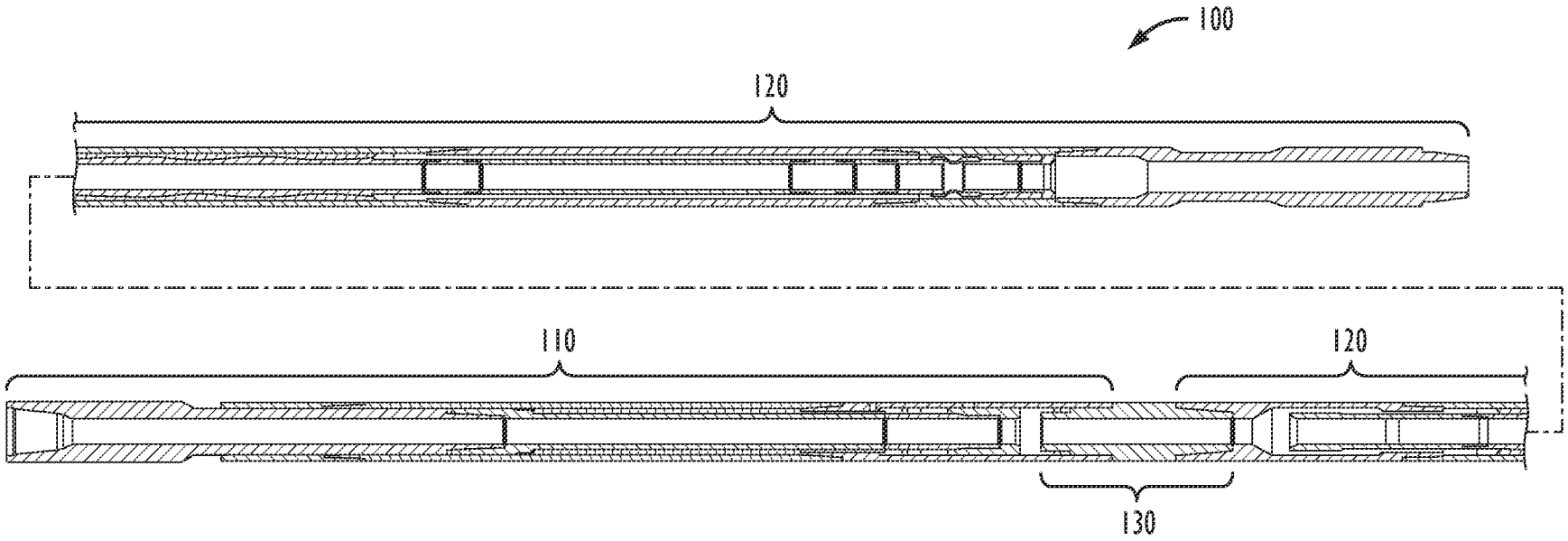
FIG. 1 is a plan view of a shock and agitator tool assembly according to one embodiment.

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form to avoid obscuring the invention. References to numbers without subscripts are understood to reference all instances of subscripts corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one."

The term "or" means any of the alternatives and any combination of the alternatives, including all of the alternatives, unless the alternatives are explicitly indicated as mutually exclusive.

The phrase "at least one of" when combined with a list of items, means a single item from the list or any combination of items in the list. The phrase does not require all of the listed items unless explicitly so defined.

In this description, the term "couple" or "couples" means either an indirect or direct connection. Thus, if a first device couples to a second device, that connection may be through a direct connection or an indirect connection via other devices and connections. The recitation "based on" means "based at least in part on." Therefore, if X is based on Y, X may be a function of Y and any number of other factors.

A downhole agitator tool is described below that utilizes pressure pulses and an accompanying shock tool to translate pressure changes into axial movement thereby causing vibration of the drill string. The disclosed tool incorporates a through bore throughout the entire tool measuring 2" or greater, which allows for the retrieval of some Measurement While Drilling (MWD) tools and allows for usage of free point and backoff equipment to facilitate removal of stuck drill strings. The disclosed tool does not require special equipment, such as a safety joint, to be installed in the drill string. However, a safety joint may be included if required for the operator's other equipment.

In one embodiment darts may be pumped downhole to activate the operation of the tool selectively. The dart lands in a dart catcher at the top of a rotor of the tool and restricts flow through the bypass, thereby causing the flow to go between the rotor and stator. This flow path causes the assembly to rotate and activates a control valve. The darts may incorporate different sized nozzles to allow for fine-tuning of the pulse frequency and pulse amplitude. The darts may be retrieved if necessary, using wireline or tubing fishing techniques. If for any reason an operator wants to modify the pulse frequency, another dart can be launched that causes a change in the frequency or enables operators to maintain the frequency they have previously been running under new flow parameters. As lateral sections of drill pipe get longer, standpipe pressure issues can occur, and often the flow rate has to be reduced. In that situation, a second dart may be launched to maintain or increase the pulse frequency at the reduced flow rate.

When in standby mode, flow proceeds through the bore of the power section, past (but not through) the control valve, and out the bottom of the tool. This reduces wear on the tool components, reduces standpipe pressure, and allows the operator to decide when they want the tool to start vibrating the drill string.

When in operational mode, the tool functions using a downhole power section with a rotating cap that has radial ports. This cap rests within a carbide sleeve that has a predetermined number of radial ports. Rotation of the cap thus causes an alternating flow restriction that creates an alternating pressure pulse. The nozzle in the dart allows for control of the pulse size and frequency. Further, this nozzle allows for protection against an overly aggressive pulse. Should the restriction at the valve be too tight, the flow will instead flow through the rotor, protecting other tools and equipment on the rig.

In one embodiment, the tool uses a robust polycrystalline diamond compact (PDC) bearing assembly that significantly reduces the required maintenance on the tool and provides great reliability.

To complement the pulsing tool, a double-acting shock tool may be included in a downhole assembly. In one embodiment, the shock tool incorporates Belleville springs and a telescoping mandrel. The geometry of the tool is designed so that changes in pressure cause the tool to extend and contract which imparts an axial motion on the adjacent drill string. This motion breaks static friction, which improves weight transfer, reduces stick-slip, and improves drill string dynamics. When assembled with the pulse tool, the shock tool amplifies the pulses produced by the pulse tool. The shock tool maximizes the pump open area and the properties of the Belleville spring stack are tuned for use with the pulse tool. The spring configuration may be adjusted on the surface to modify the axial movement of the mandrel.

Turning now to FIG. 1, an overview of a shock and agitator tool assembly 100 for inclusion in a drill string is illustrated in a plan view according to one embodiment. A shock tool 110 and an agitator tool 120 are coupled using coupling 130 to form the shock and agitator tool assembly 100, as illustrated in more detail in FIGS. 2-4 and described below. In one embodiment, the tool assembly has a 5¼ outer diameter (OD) with threads provided for connection to other sections of the drill string, but other embodiments may use other diameters. The shock tool 110 may be used without the agitator tool 120 and the agitator tool 120 may be used without the shock tool 110.

Figure 2:
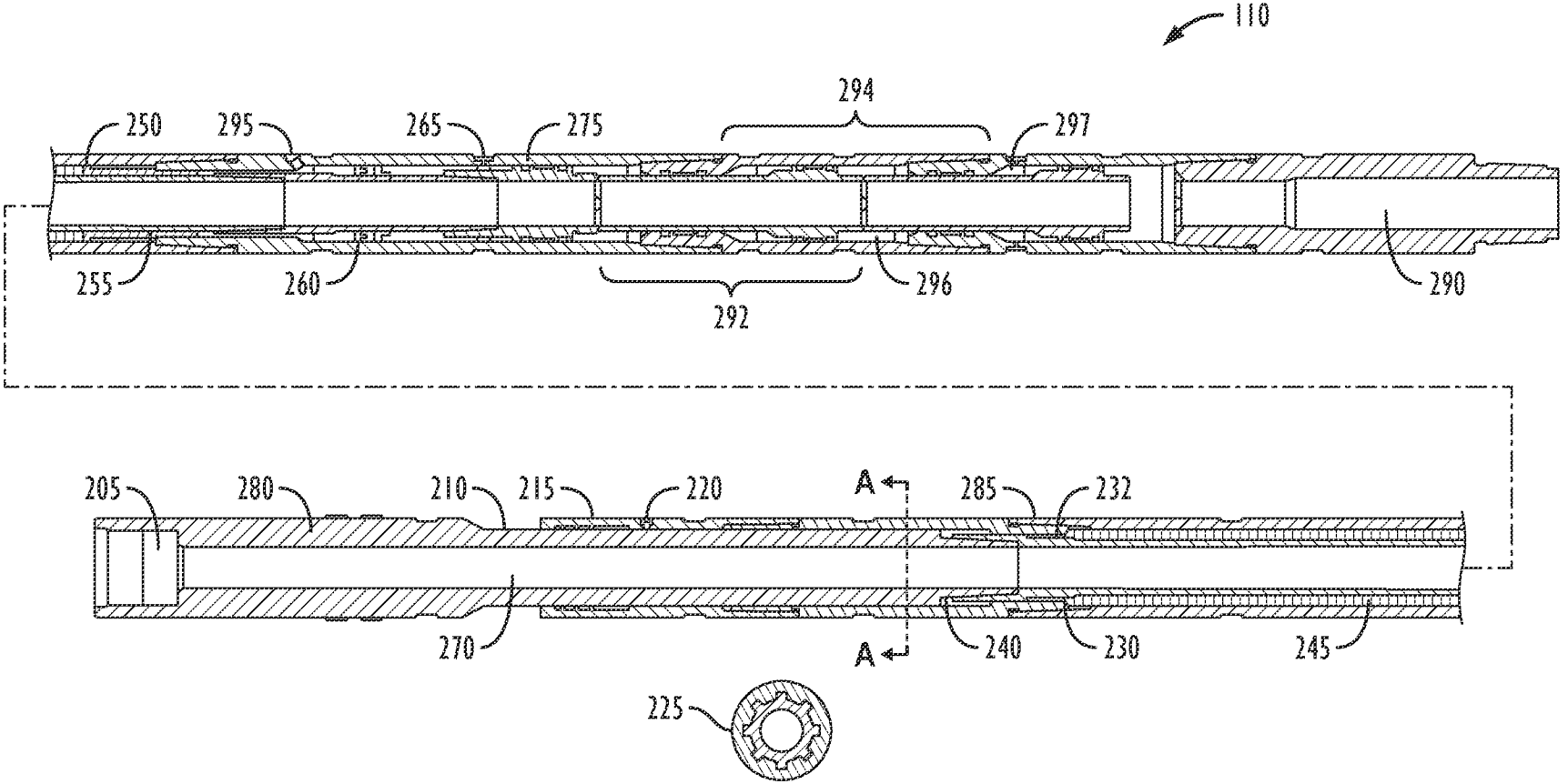
FIG. 2 is a plan view of a shock tool of the shock and agitator tool assembly of FIG. 1 according to one embodiment.

FIG. 2 is a detailed view of the shock tool 110 of the shock and agitator tool assembly 100 of FIG. 1 according to one embodiment. The shock tool 110 comprises a double-acting shock tool that imparts an axial motion to drill string that is adjacent to the shock tool 110. This motion breaks static friction, which improves weight transfer, reduces stick-slip, and improves drill string dynamics.

The shock tool 110 is designed for threaded connection to the drill string using box thread section 205. An open bore 270 maximizes the open volume for fluid flow through the shock tool 110. In operation, a first mandrel 280 moves longitudinally relative to an outer housing 285, imparting the axial motion to the adjacent drill string.

A polished carbide seal outer surface area 210 provides a reduced friction surface for relative movement between first mandrel 280 and outer housing 285. An upper seal assembly 215 seals between the first mandrel 280 and outer housing 285, preventing fluid flow between them. The first mandrel, as shown in cross-section 225 taken at line A—A, may be formed with splines or other anti-rotation elements to allow transmission of torque from the drill string through the first mandrel 280 to the outer housing 285, preventing rotation of the first mandrel 280 relative to the outer housing 285.

A spacer ring 230 surrounding a second mandrel 232 coupled to the first mandrel 280 provides axial loading from a collection of Belleville springs 245 between mandrels and housings. The Belleville springs 245 are configured to allow spring compression under expected downhole loads. The spacer ring 230 provides axial loading when the shock tool 110 is in compression, and an upper spring load surface 240 provides axial loading when the shock tool 110 is in tension. A lower spring load surface 255 provides axial loading when the shock tool 110 is in tension. A lower spring load surface 250 provides axial loading when the shock tool 110 is in compression. Although described in terms of Belleville springs, other types of springs can be used as desired.

A balance piston 260 compensates for oil expansion and reduces pressure at the moving seals of the sealed area 275. Fill ports for the oil chamber are located at 220 and 295. A vent port 265 provides venting to the outside of the shock tool 110, so that fluid pressure through the vent port 265 on the sealed area 275 allows changes in pressure in the fluid internal to the shock tool 110 to open or lengthen the shock tool 110, resulting in axial movement of the first mandrel 280 relative to the outer housing 285, resulting in axial movement of the connected drill string.

An amplifier mandrel 292 provides an upward force on the shock mandrel whenever a pressure difference is experienced between internal and external volumes. An amplifier housing 294 adds an improved pump open area for enhanced tool performance. A high-pressure fluid area 296 in communication with internal fluid is affected by pulses from the pulse generator section, while a low-pressure fluid area 297 is vented to the annulus. Multiple amplifier stages can be added as required, limited by the total pump open force, which cannot exceed the Belleville spring 245 force plus the weight on bit experienced. This design does not require the amplifier components to be assembled onto the base shock tool.

A coupling 290 allows coupling the shock tool 110 to the agitator tool 120.

Figure 3:
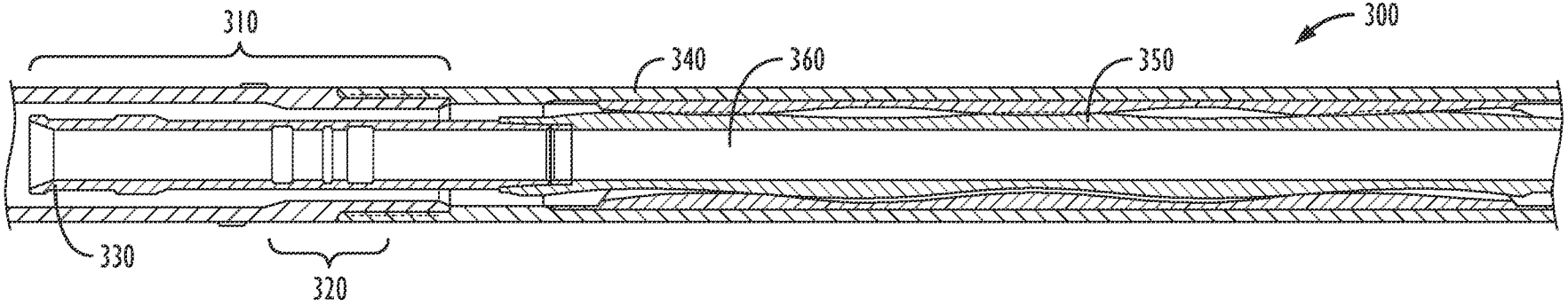
FIG. 3 is a plan view of a power section of an agitator tool of the shock and agitator tool of FIG. 1 according to one embodiment.

FIG. 3 is a plan view illustrating details of a power section 300 of the agitator tool 120. The power section 300 provides rotation to the agitator tool 120. A dart catching section 310 is formed at an uphole end of an inner mandrel 350 for catching control darts that can be dropped downhole to control the agitator tool 120. The dart catching section comprises a guide section 330 shaped to guide darts into the dart catching section. A locking profile 320 engages with a dart (not shown in FIG. 3) to retain the dart from further movement downhole but is configured to release the dart when a predetermined target pull force is reached, allowing the dart to be recovered back uphole. When the dart is not engaged with the dart catching section 310 and profile 320, drilling fluid passes through the bore 360 of the agitator tool and does not activate the agitator tool 120. In this mode, the agitator tool 120 remains in standby, for times when there is no need for or desire for the agitation of the drill string. In one embodiment, the bore 360 has a diameter of at least 2" (approximately 5 cm), but other embodiments may have different diameters. An outer housing 340 and an inner mandrel 350 form a power section with a fluid-driven motor, with the outer housing 340 being the stator and the inner mandrel 350 being the rotor of the fluid-driven motor. When the dart is engaged with the dart catching section 310 and profile 320, drilling fluid is forced to flow between the outer housing 340 and the inner mandrel 350 of the agitator tool 120, causing the inner mandrel 350 to rotate relative to the outer housing 340 because of the configuration of the outer surface of the inner mandrel 350 and the inner surface of the outer housing 340. This rotation powers the agitator tool 120 to perform agitation. An example of an agitator tool 120 that can be activated and powered in this way can be found in U.S. Pat. No. 10,989,004. which is incorporated by reference in its entirety for all purposes.

Although illustrated for controlling an agitator tool 120, the dart catching techniques described herein may be used for controlling other types of downhole tools.

Figure 4:
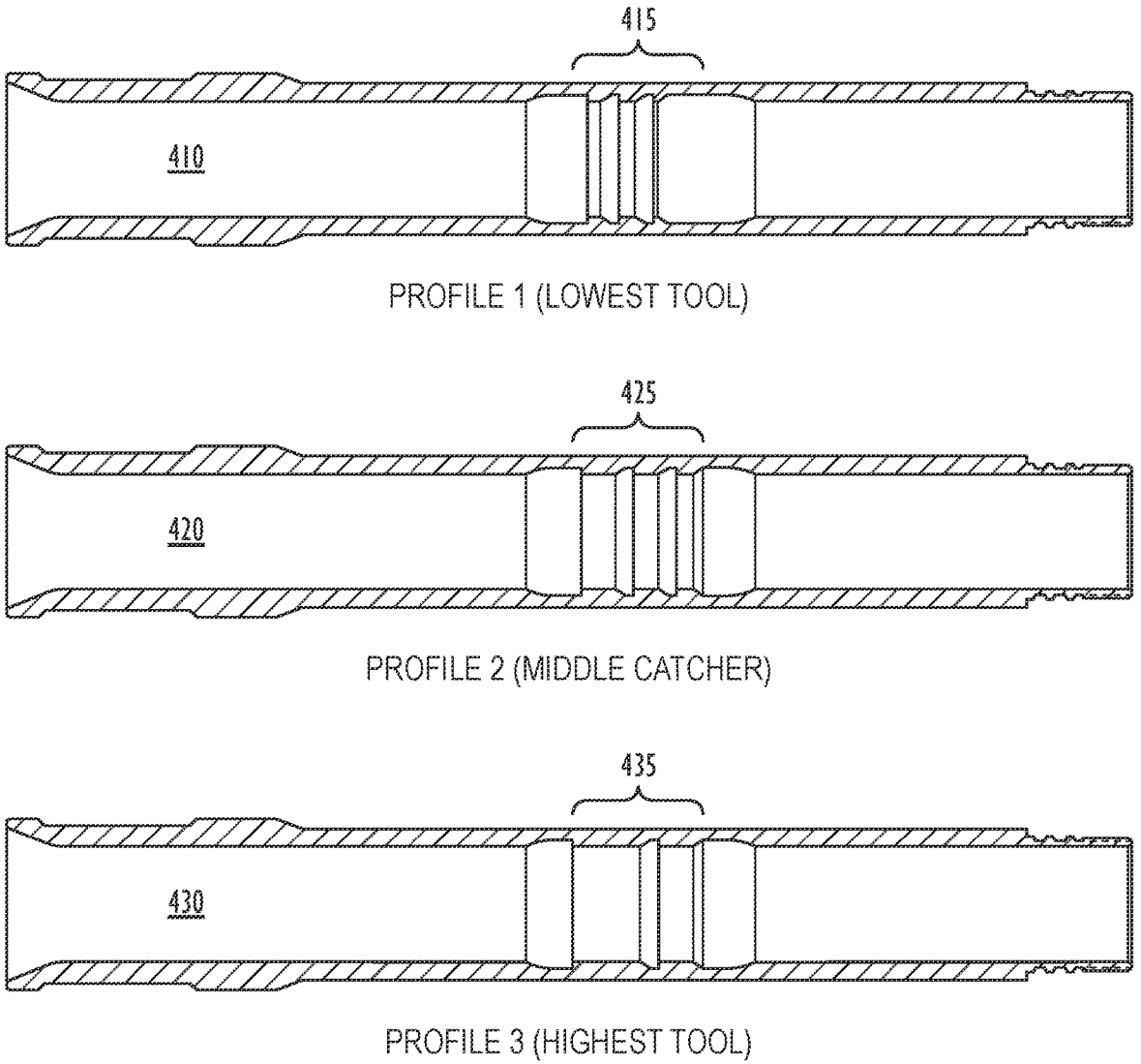
FIG. 4 is a plan view of multiple dart-catching sections for a downhole tool according to one embodiment.

FIG. 4 is a plan view illustrating three different dart-catching sections 410, 420, and 430 according to one embodiment. Keyed profiles 415, 425, and 435 are formed in an inner surface of dart catching sections 410, 420, and 430 for catching appropriately configured darts dropped downhole. The keyed profiles 415, 425, and 435 are formed in an inner surface of the dart catching sections 410, 420, and 430, and comprise a sequence of keys that can engage with corresponding key sections of darts but which do not engage with other key sections having a different configuration. By using different dart-catching sections in different downhole tools in a downhole string, multiple downhole tools in the downhole string may be controlled. As illustrated in FIG. 4, dart catching section 410 may be used in the lowest (furthest downhole) tool, dart catching section 420 may be used in a middle tool, and dart catching section 430 may be used in the highest (furthest uphole) too, with darts configured for engagement with dart catching section 410 passing through dart catching sections 420 and 430 unhindered and darts configured for engagement with dart catching section 420 passing through dart catching section 430 unhindered. The specific profiles illustrated in FIG. 4 are illustrative and by way of example only, and other profiles may be used that allow the use of darts to control multiple tools in the downhole string as described above.

Figure 5:
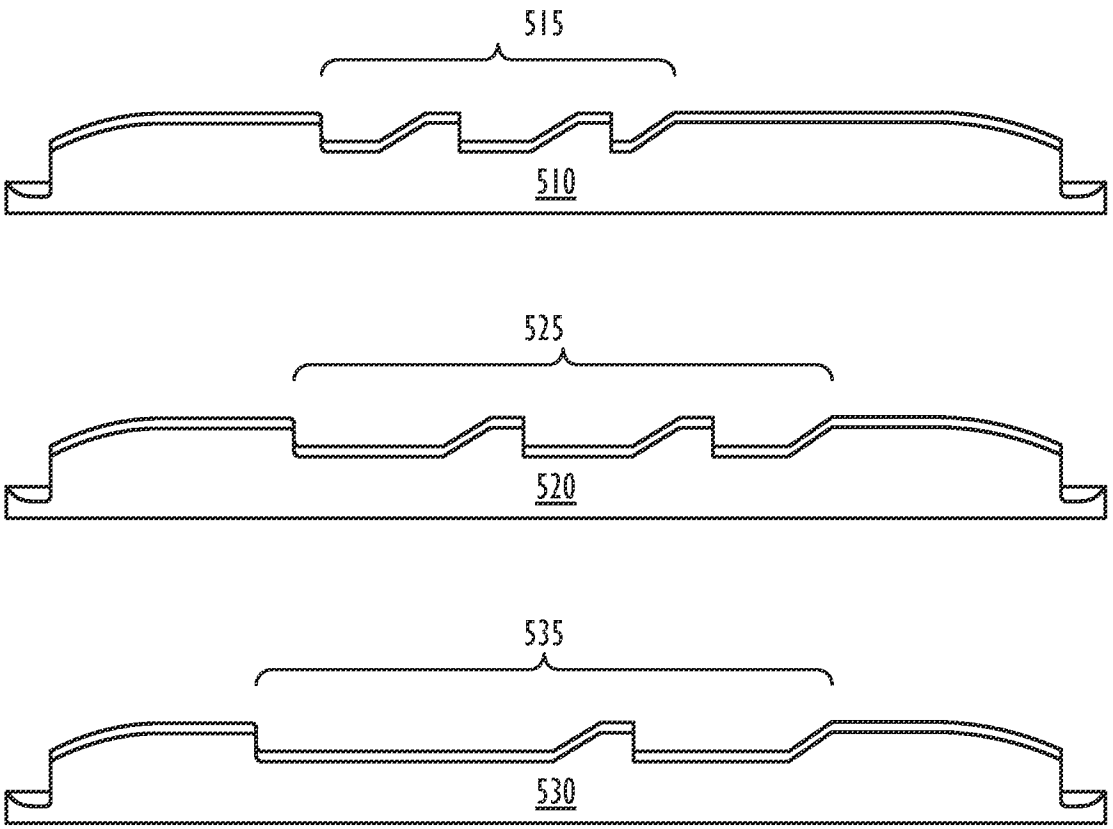

FIG. 5 is a plan view illustrating three different key sections 510, 520, and 530 for use on darts according to one embodiment. Key section 510 is configured with a sequence of notches or keys 515 that form a profile that engages with a corresponding keyed profile 415 of dart catching section 410, but not keyed profiled 425 or 435 of dart catching sections 420 or 430. Thus, a dart having key sections 510 may be dropped downhole to affect a downhole tool having dart catching section 410 while passing through without affecting downhole tools having dart catching sections 420 and 430. Similarly, a dart having key sections 520 is configured with notches 525 that form a profile that engages with dart catching section 420, but not dart catching section 430. Such a dart may then be dropped downhole to affect a downhole tool having dart catching section 420 while passing through without affecting a downhole tool having dart catching section 430. Furthermore, a dart having key sections 530 is configured with notches 535 that form a profile that engages with dart catching section 430. Such a dart dropped downhole may then be used to affect a downhole tool having dart catching section 430. This allows independently controlling each of three levels of downhole tools with properly configured darts. As illustrated in FIGS. 4-5, key sections 510, 520, and 530 and dart catching sections 410, 420, and 430 are configured so that darts dropped downhole and engaged with one of the dart catching sections 410, 420, or 430 can be retrieved uphole.

Although three dart-catching sections 410, 420, and 430 and three key sections 510, 520, and 530 are illustrated in FIGS. 4-5, one of skill in the art understands that the profiles illustrated in FIGS. 4-5 are illustrative and by way of example only, and other dart-catching sections and key sections may be used. Similarly, one of skill in the art understands that the notches 515, 525, and 535 of the key sections 510, 520, and 530 and profiles 415, 425, and 435 of the dart catching sections 410, 420, and 430 are illustrative and by way of example, and other arrangements and configurations of key sections and profiles can be used.

Figure 6:
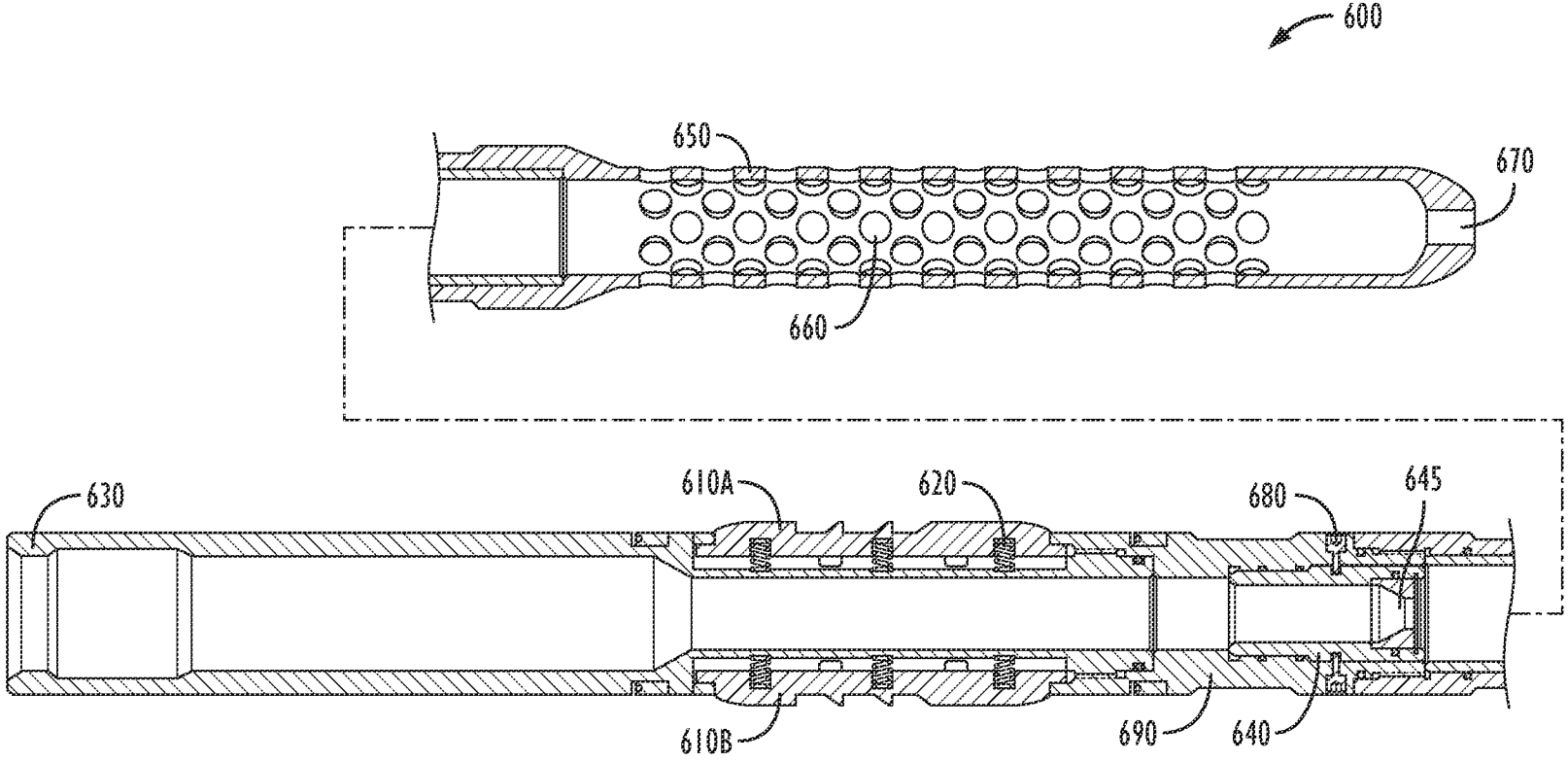
FIG. 6 is a plan view of dart according to one embodiment.

FIG. 6 is a plan view illustrating a dart 600 containing key sections 610A, 610B similar to key section 510 for engaging with a lower downhole tool having a dart catching section 410. Key sections are disposed on an outer surface of a dart body 690, to engage with corresponding profiles on an inner surface of dart catching sections 410, 420, and 430. One or more springs 620 are used to urge key sections 610A, 610B radially outward to ensure their engagement with the dart catching section 410. Because of their configuration, dart 600 can be dropped downhole through downhole tools that are further uphole and having dart catching sections 420 or 430, engaging only with the downhole tool having dart catching section 410. A dart retrieval section 630 allows for retrieval of the dart 600 uphole by a wireline tool (not illustrated) if desired, should an operator not want the downhole tool to run continuously or may need to reach equipment below the downhole tool.

Figure 14:
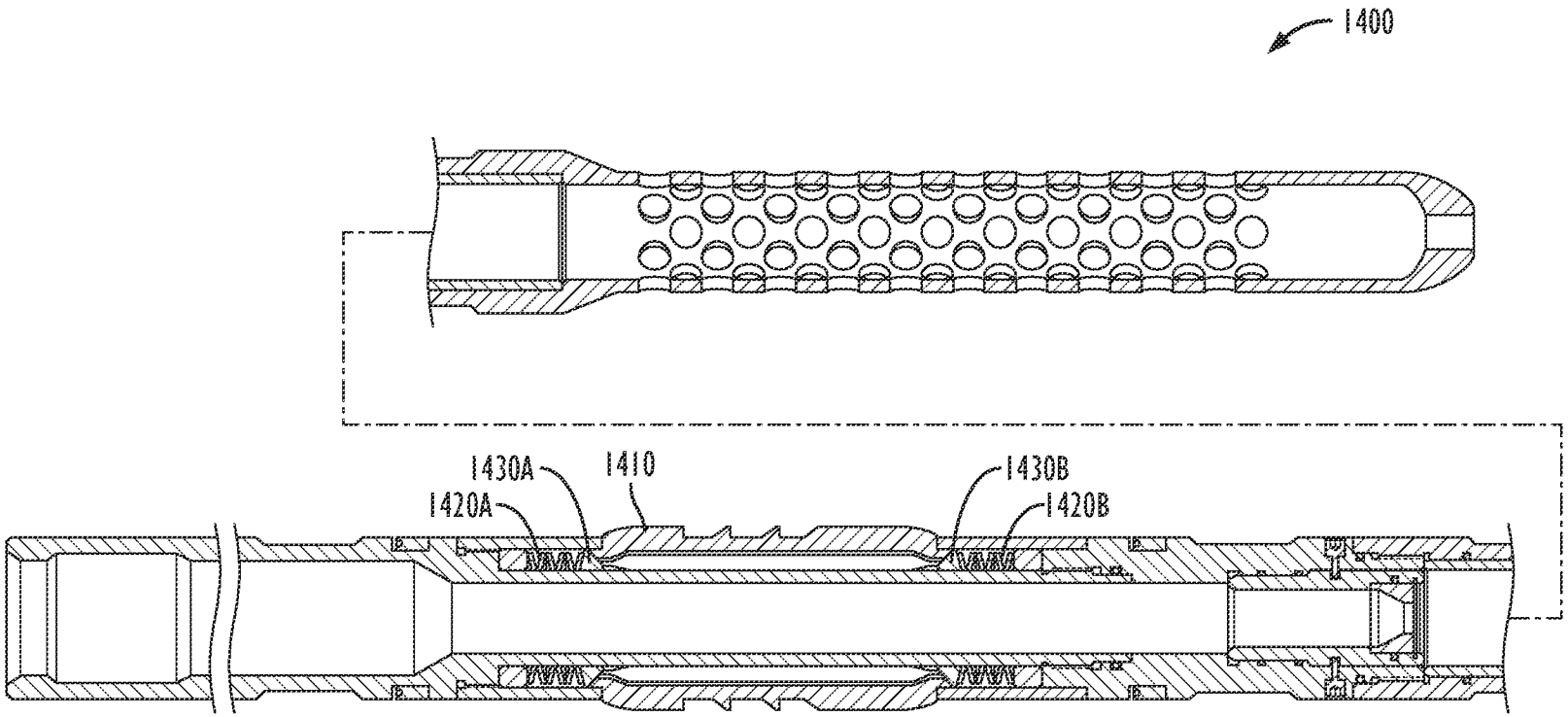
FIG. 14 is a plan view of another embodiment of a dart.

In an alternate embodiment illustrated in plan view in FIG. 14, instead of radially biasing the key sections 610A, 610B with radially oriented springs 620 as illustrated in FIG. 6, the dart 1400 of FIG. 14 employs Belleville springs 1420A, 1420B that urge blocks 1430A, 1430B laterally. An angled portion of blocks 1430A, 1430B urges the key section 1410 radially outward. Other alternate mechanisms may be used to urge the key section 1410 radially outward as desired.

A removable nozzle retainer 640 affixed in a bore of the dart 600 by one or more shear pins 680 allows for modification of tool performance while the tool is already downhole. The shear pins are configured to shear at a predetermined pumping pressure on the nozzle retainer 640, separating the nozzle retainer 640 from the dart body 690. Other techniques for holding the nozzle retainer 640 in place until the predetermined pumping pressure may be used. The nozzle retainer 640 has attached a nozzle 645 that diverts fluid flow for controlling an agitator tool 120 or other downhole tools containing a corresponding dart catching section 410. As described below, the removable nozzle retainer 640 is separable from the dart body, allowing the nozzle retainer 640 to move downhole into the basket section 650, where the nozzle retainer 640 and nozzle 645 are retained, allowing fluid to flow downhole through an array of openings 660 and basket nose port 670 without the diversion caused by nozzle 645.

The nozzle 645 may be set on the surface to control the frequency of rotation to be performed by the power section 300 of the agitator tool 120, based on the amount of diversion of the fluid flow rate through the bore 360 created by the nozzle 645. For example, the greater the restriction of flow the greater the diversion into the power section 300, resulting in faster rotation of the inner mandrel 350 and a higher frequency of the resulting vibrations in the agitator tool 120. Other tools may use changes in fluid flow for other purposes. In some embodiments, the nozzle 645 may completely block fluid flow through the bore 360, but generally, some flow remains with the dart 600 in place. Until the dart 600 is pumped into the dart catching section 410, 420, 430, fluid flows unrestricted through the bore 360 because of its large size. Once the dart 600 has engaged with the dart catching sections 410, 420, 430, nozzle 645 diverts flow from the bore 360, so that fluid flows around the inner mandrel 350, causing rotation of the inner mandrel 350.

Similar darts can be deployed with key sections 610A, 610B that are configured to engage with dart-catching sections 420 or 430. Although FIG. 6 illustrates two key sections on the dart 600, other numbers of key sections may be used if desired.

Figure 7:
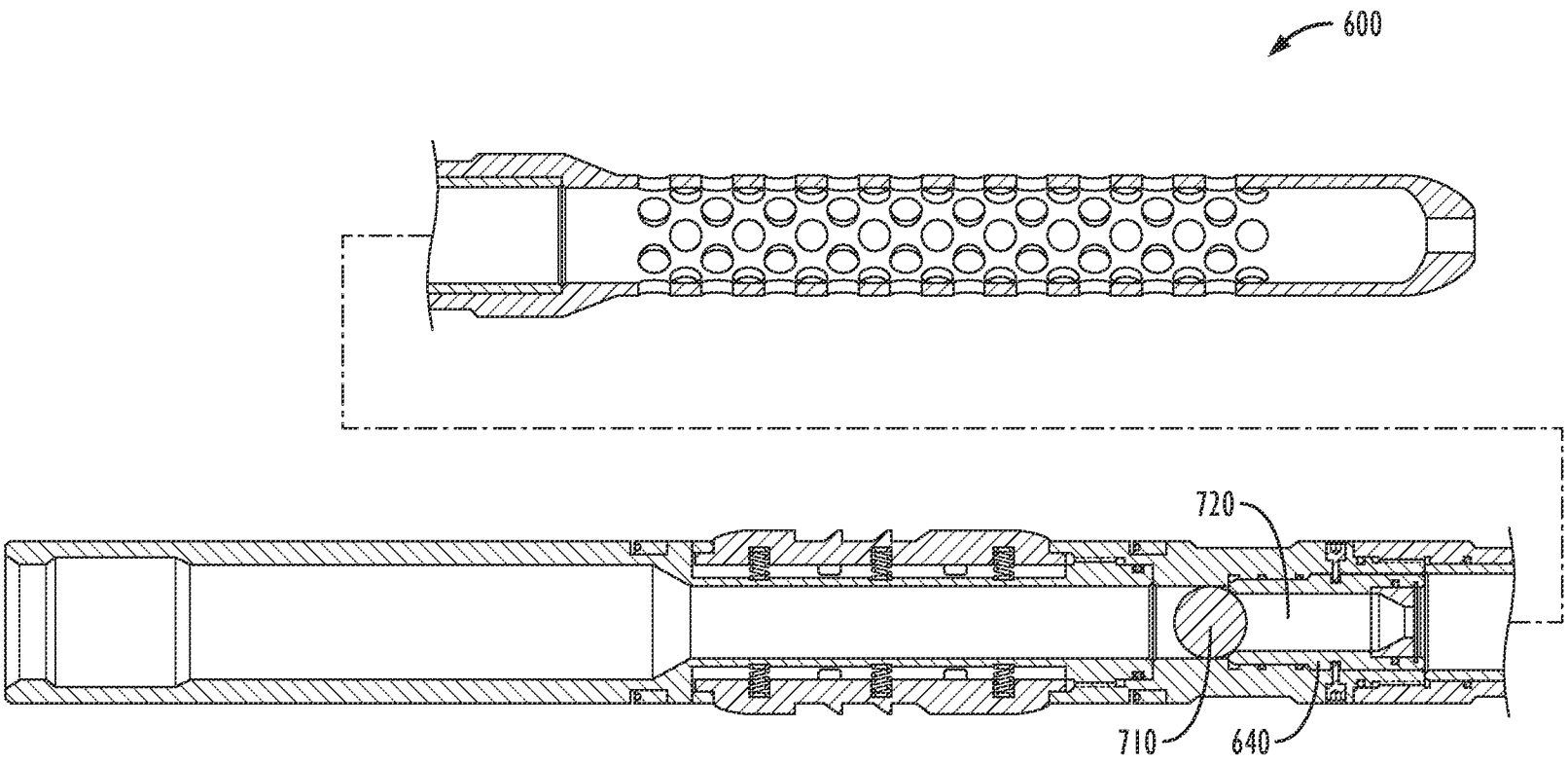
FIGS. 7-9 are plan views illustrating the use of a dart for activating the agitator tool of FIG. 3 according to one embodiment.
Figure 8:
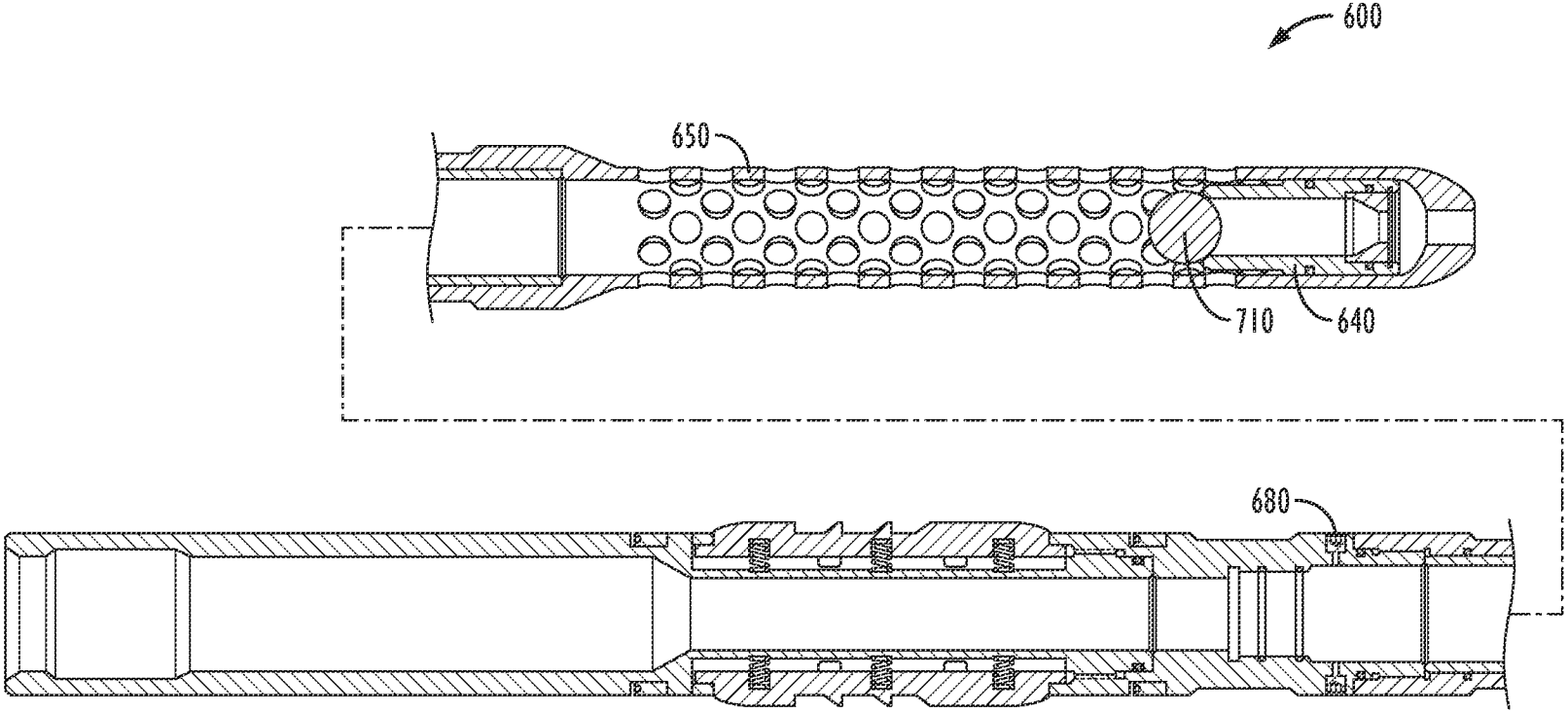
Figure 9:
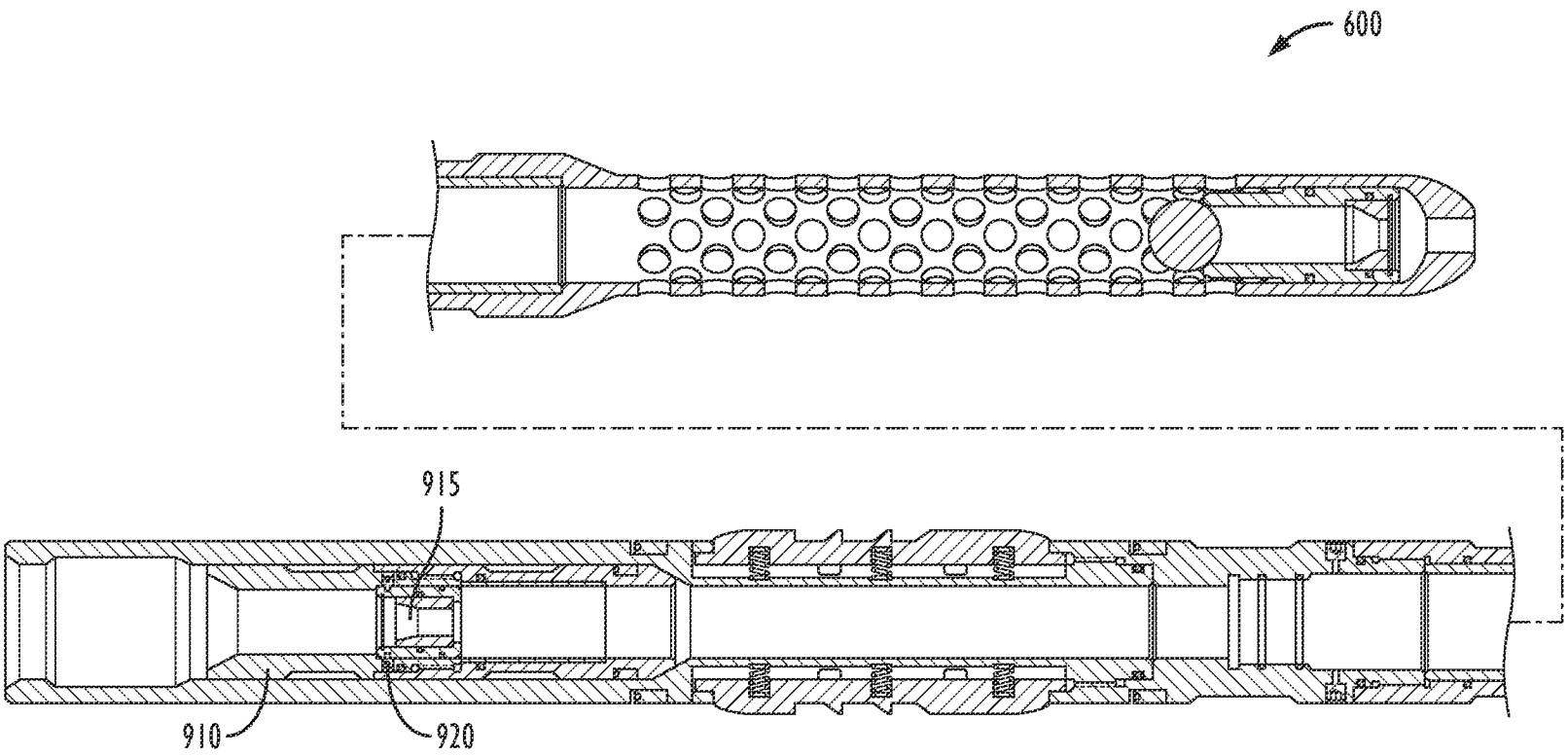

FIGS. 7-9 are plan views illustrating a technique for modifying the behavior of a downhole tool such as agitator tool 120 with a dart such as the dart 600 of FIG. 6. Although not shown in FIGS. 7-9, in this example, the dart 600 has previously been dropped downhole and engaged with the dart catching section 310 of the agitator tool 120, activating the agitator tool 120. In FIG. 7, a ball 710 has been dropped downhole and engaged with the nozzle retainer 640, closing a bore 720 through the nozzle retainer 640 and eliminating fluid flow through the dart 600. In FIG. 8, increased pumping pressure causes shearing of shear pins 680, causing disengagement of the nozzle retainer 640, which then moves into basket section 650, where it is retained. Should the dart 600 be retrieved uphole, the nozzle retainer 640 can be retrieved from basket section 650 for remounting on shear pins 680 and reuse of the dart 600. Because this removes the diversion of fluid flow created by the nozzle 645, the agitator tool 120 is deactivated as a result of dropping the ball 710 and separating the nozzle retainer 640. The operator may wish to continue drilling for some time with the agitator tool 120 deactivated. After that time, the operator may want to return to the same or modified conditions with a different nozzle, as described below.

In some situations, an operator having pumped the dart 600 into place as described above may wish to modify the flow through the agitator tool 120 to change the frequency of the vibrations produced or through another downhole tool to change its operating parameters. In that situation, a second dart may be dropped or pumped downhole to be captured by an uphole end of the dart 600.

In FIG. 9, a second dart 910 has been dropped downhole and captured by dart 600. Second dart 910 has a different nozzle 915 that changes fluid flow through dart 600, thus modifying tool operating parameters of the agitator tool 120 or other downhole tool remotely. Nozzle 915 may be held in place with shear pins 920. Second dart 910 can be retrieved uphole independent of dart 600 or together with dart 600, allowing further modification of the operating parameters of agitator tool 120 or other downhole tool. The use of changes in fluid flow through a tool to change operating parameters of the tool is well known and need not be described further herein.

Figure 10:
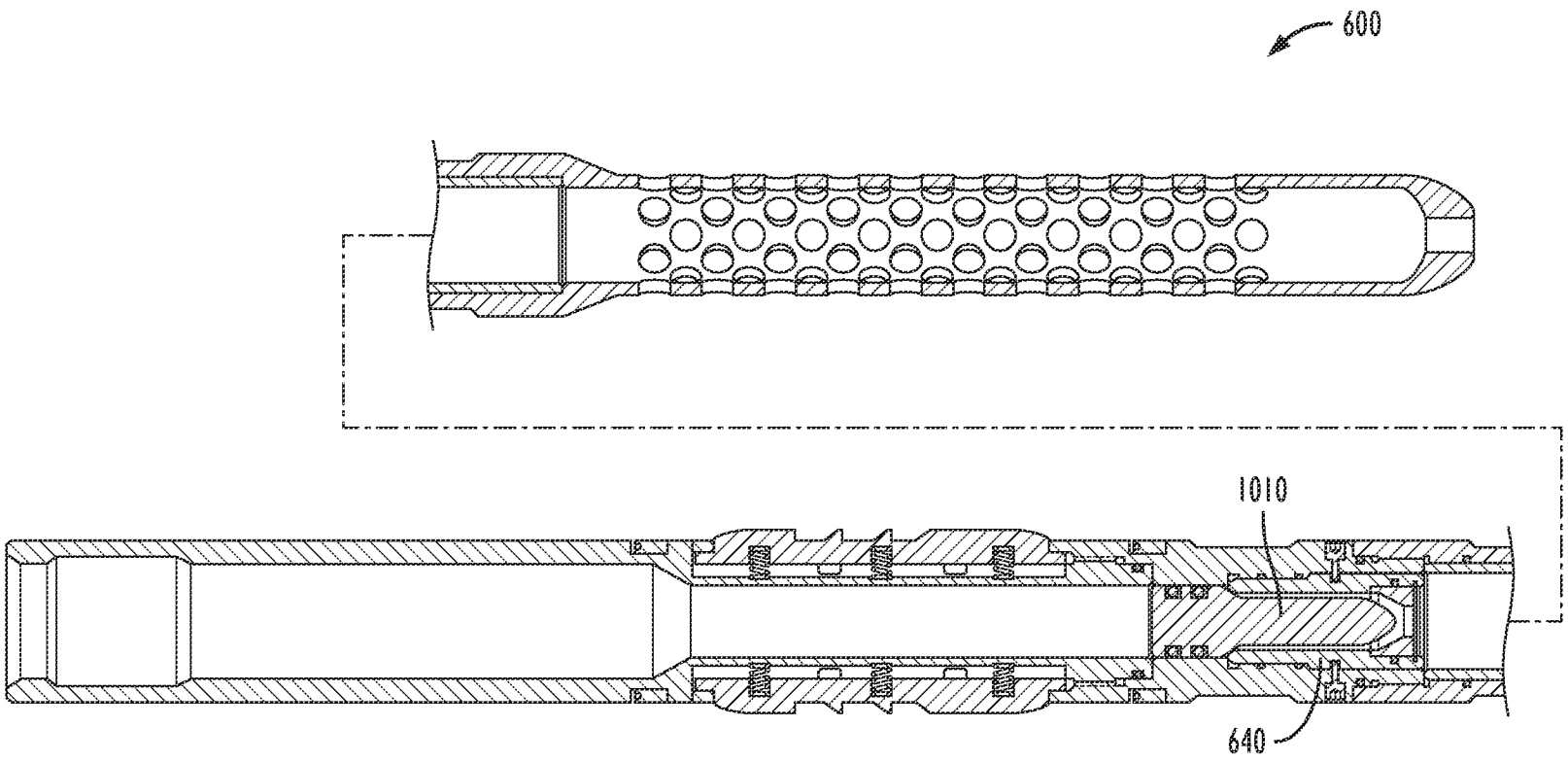
FIGS. 10-12 are plan views illustrating an alternative technique for using a dart according to one embodiment.
Figure 11:
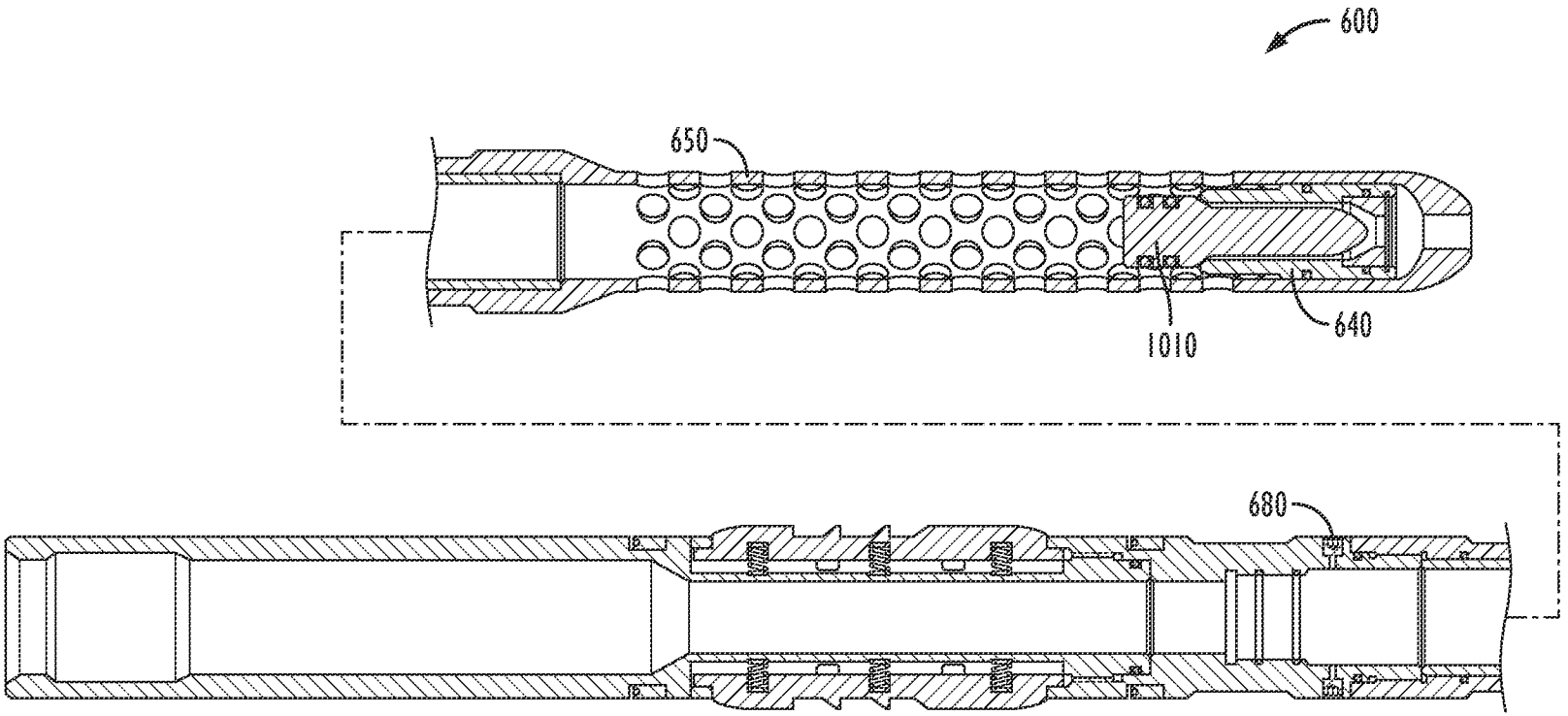
Figure 12:
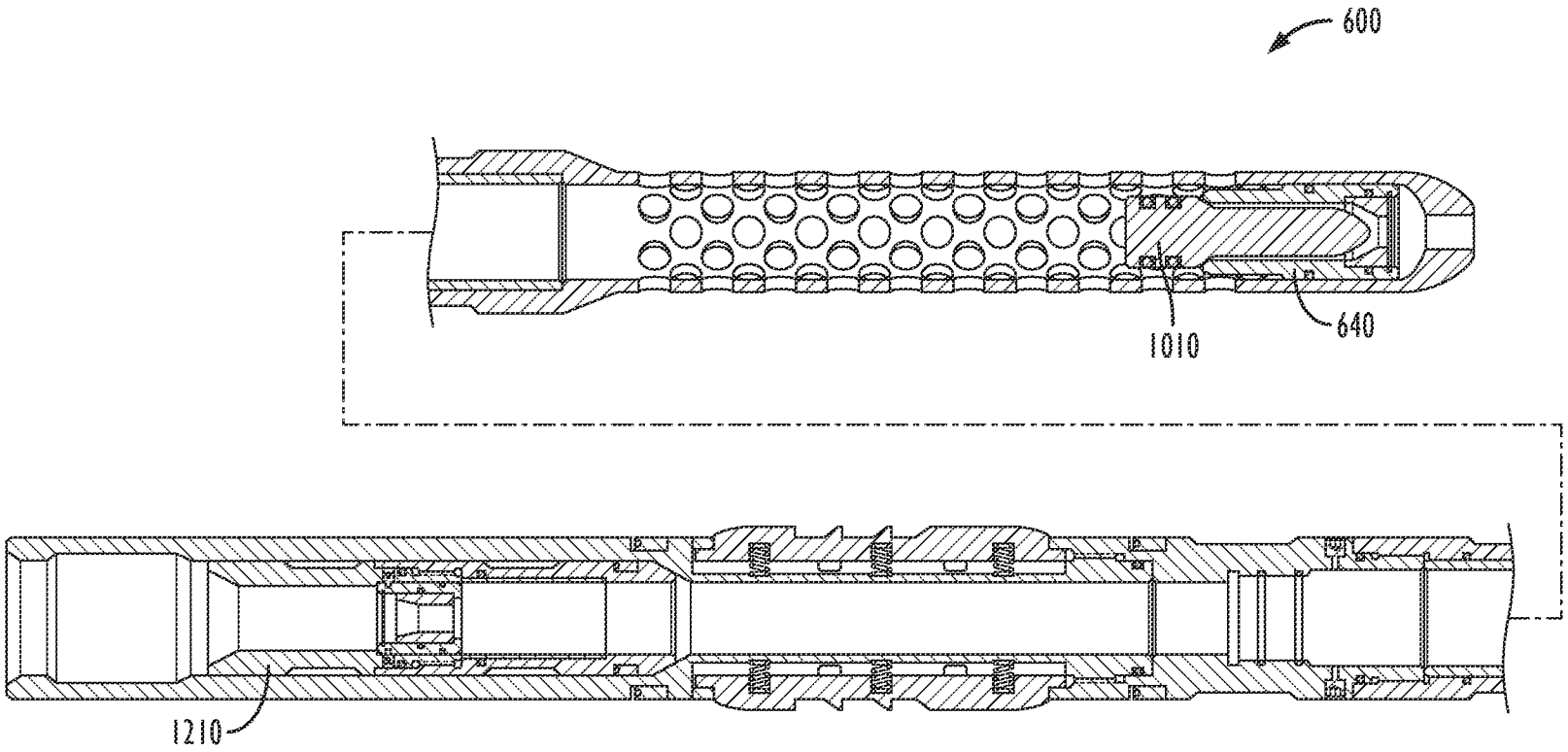

Instead of using a ball as illustrated in FIGS. 7-9, other techniques can be used to cause disengagement of the nozzle retainer 640. For example, FIGS. 10-12 illustrate the use of a plug for the same purpose. In FIG. 10, a plug is dropped downhole, engaging with nozzle retainer 640. In FIG. 11, increased pumping pressure has sheared shear pins 680, causing the plug 1010 and nozzle retainer 640 to move and be caught by basket section 650. In FIG. 12, a second dart 1210 may then be dropped from the surface downhole to engage with dart 600, further changing fluid flow through dart 600. Other types of objects besides balls and plugs can be used similarly.

By the use of the techniques illustrated in FIGS. 7-12, a downhole tool may be activated, deactivated, or have its operating parameters modified remotely by dropping a dart such as dart 600, further modified by dropping a ball, plug, or other objects, and yet further modified by dropping a second dart 910, 1210 to engage with the dart 600. Multiple tools in the same string may be independently remotely controlled using these techniques by dropping darts with appropriate key sections into tools with corresponding profiles. Although the discussion above indicates that the darts, balls, plugs, etc. are dropped downhole, one of skill in the art understands that those objects can be pumped downhole instead of dropped from the surface.

As described above and illustrated in FIGS. 7-9 and 10-12, the second dart 910, 1210 may be dropped after an object has been dropped into the first dart 600 and an object such as the ball 710 and plug 1010. However, the second dart 910, 1210 may be dropped without first dropping the ball 710 or plug 1010, allowing the second dart 910, 1210 to modify the operational parameters of the downhole tool without first deactivating the downhole tool.

In some scenarios, an operator could run the shock and agitator tool assembly 100 with full fluid flow, then drop a dart 600 to cause the agitator tool 120 to begin vibration, with the dart 600 configured for a predetermined vibration rate or frequency. When agitation is no longer needed, the dart 600 may be withdrawn uphole, returning to full bore fluid flow. A second dart 910, 1210 can be used to adjust the vibration frequency, as described above. In addition, the original dart 600 may simply be pulled back uphole and a new dart 600 dropped with the nozzle 645 configured for a different vibration frequency.

Figure 15:
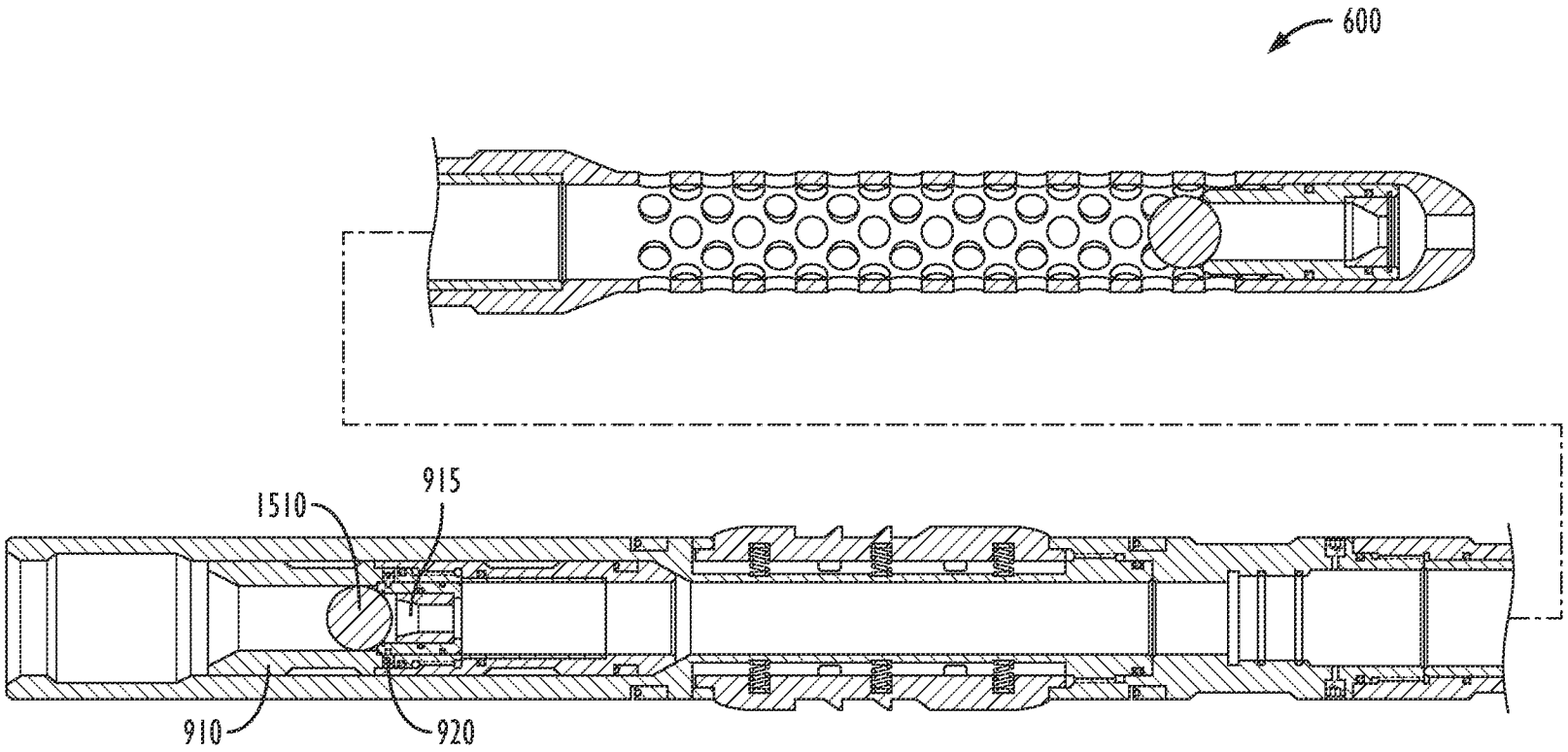
FIGS. 15-18 are plan views illustrating additional techniques for activating and deactivating a downhole tool.
Figure 16:
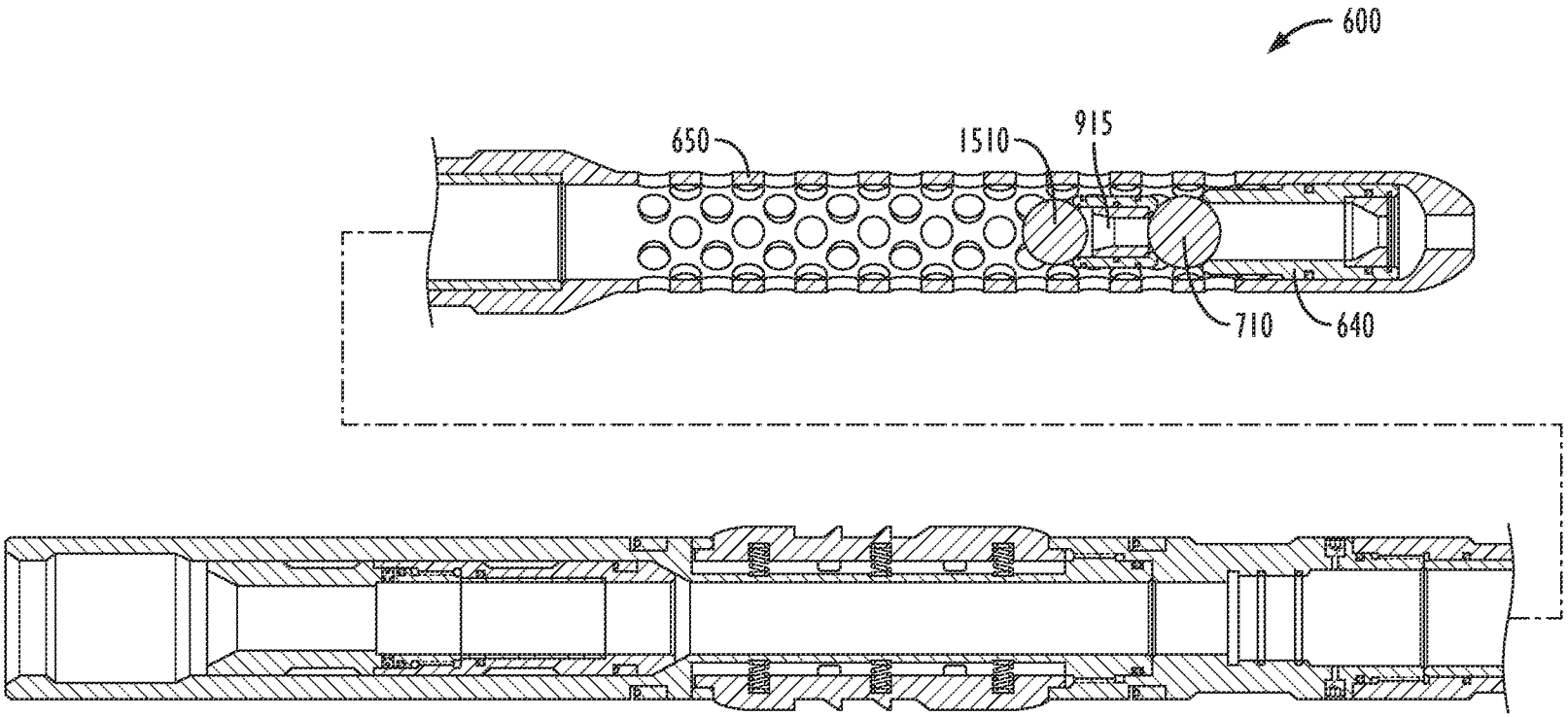

FIGS. 15-18 are plan views illustrating additional techniques for activating and deactivating a downhole tool. As described above, a second dart may be dropped into the dart 600 to activate or change the operational parameters of a downhole tool a second time. As illustrated in FIGS. 15-16, a ball 1510 may be dropped downhole to engage with the second dart 910, allowing pumping pressure to cause shear pins 920 to disengage the nozzle 915, which then flows downhole to be captured in the basket section 650. If a previous ball 710 (or plug 1010) has been used to cause the nozzle retainer 640 to separate and be caught in the basket section 650, the basket section 650 catches both the nozzle retainer 640 and ball 710 (or plug 1010) and the ball 1510 and nozzle 915.

Figure 17:
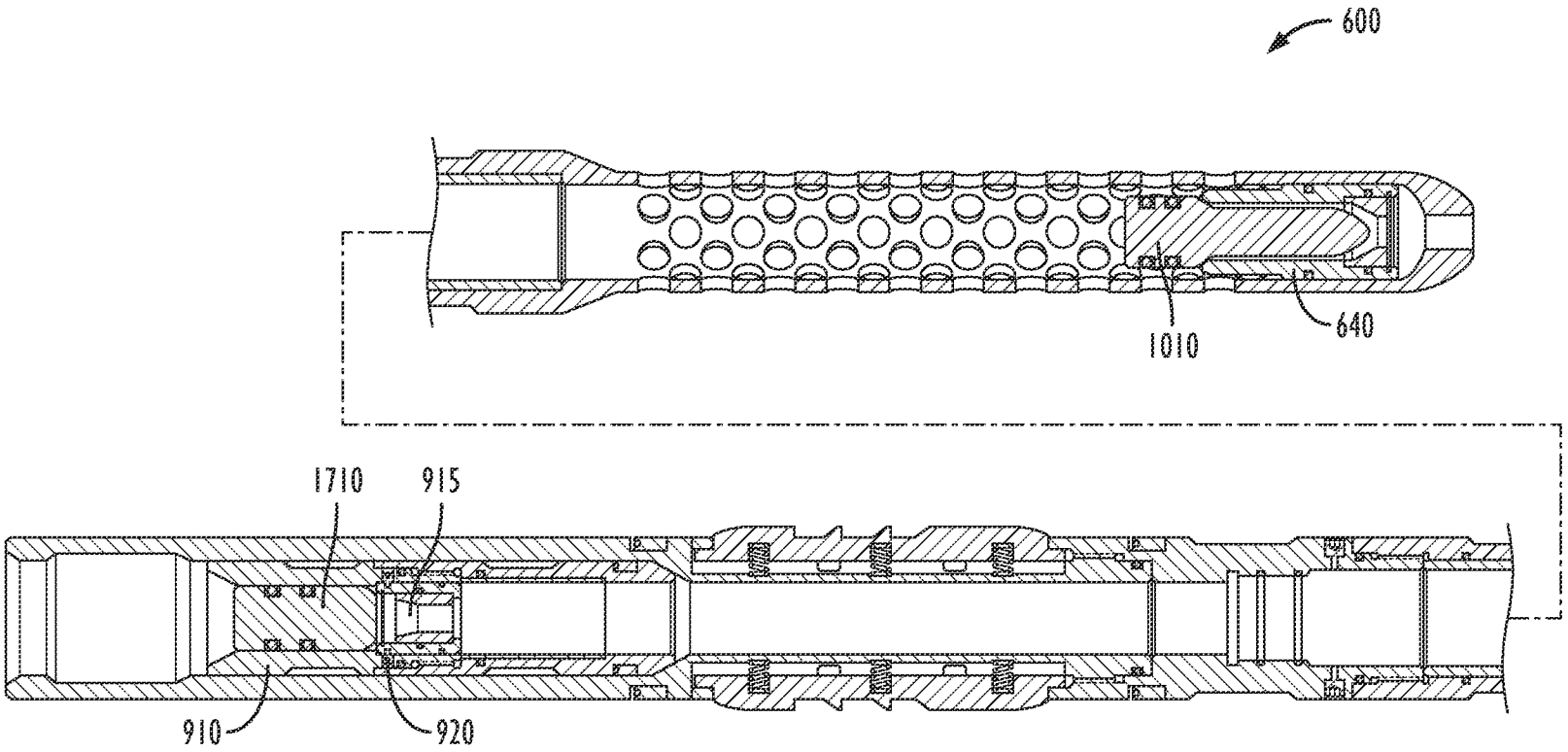
Figure 18:
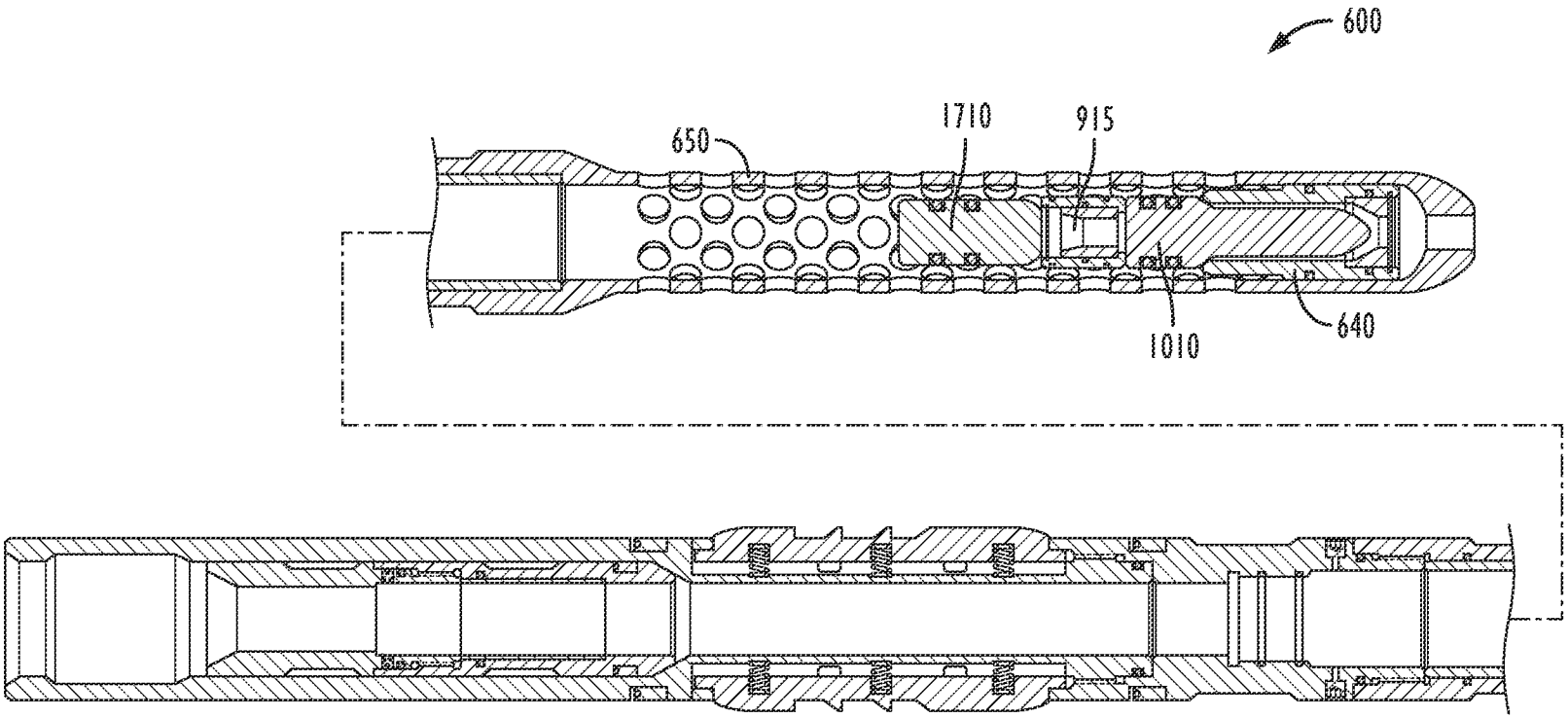

Similarly, as illustrated in FIGS. 17-18, a plug 1710 may be dropped downhole to engage with the second dart 910, allowing pumping pressure to cause shear pins 920 to disengage the nozzle 915, which then flows downhole to be captured in the basket section 650. If a previous plug 1010 (or ball 710) has been used to separate and catch the nozzle retainer 640 in the basket section 650, the basket section 650 catches both the nozzle retainer 640 and plug 1010 (or ball 710) and the plug 1710 and nozzle 915. Although as illustrated either a ball or a plug is used with both the first and second darts, one skill in the art would understand that different types of objects may be used in each of the two darts.

The shock and agitator tool assembly 100 may be used as a single sub. Alternately, the agitator tool 120 may be made up by itself in the drill string if the shock tool 110 is not needed. In normal operation, the agitator tool 120 begins with full through bore fluid flow, pumping down a dart 600 only when agitation or vibration of the agitation tool 120 is needed, then returning to full through bore fluid flow when vibration is no longer needed by removing dart 600.

As described above, two darts may be used to control the agitator tool 120. In some embodiments, additional darts can be used, with each successive dart engaging with the previous dart, and further affecting flow through the bore 360 of the power section 300, allowing additional adjustment of the frequency of rotation and thus the vibrations produced by the agitator tool 120. Each successive dart would be smaller than its predecessor. In one embodiment, the additional dart may seal the first and second darts, fully activating the power section and thus the agitator tool 120. In yet another embodiment, a dart can be pumped into the drill string that causes a breakup up or complete dislodging of the dart 600, allowing the dart 600 to be pumped through the bore 360, restoring full fluid flow through the bore 360.

The tools, darts, and techniques described above allow flow through the bore of the downhole tool. The downhole tool can thus be activated, deactivated, or have its operational parameters changes while downhole without wireline intervention. The operator can continue drilling while the downhole tool is deactivated, then reactivate the tool when desired.

The large bore 360 of the shock and agitator tool assembly 100 allows the use of other tools, such as MWD or well intervention tools, that might not be usable downhole of previous vibration tools that have restricted fluid flow and smaller bores. The vibrations created by the agitator tool 120 do not interfere with MWD operations, and the agitator tool 120 provides a minimal pressure drop until a dart 600 is pumped downhole to engage the agitator tool 120.

In addition, unlike conventional agitator tools, the large bore 360 of the shock and agitator tool assembly 100 would allow an operator to make up a drill string with multiple agitator tools 120, whether separate subs or combined with a shock tool 110 as a shock and agitator tool assembly 100. Each agitator tool 120 in the drill string could have the same bore 360 as the next agitator tool 120 downhole, so that darts 600 for a desired agitator tool 120 would pass through uphole agitator tools 120, but engage with the proper dart catching section 410, 420, 430 of the desired agitator tool 120 in the drill string.

Alternate dart designs may replace or modify the nozzle retainer 640, nozzle 645, and basket section 650. For example, as illustrated in U.S. Pat. No. 10,989,004, which is incorporated by reference in its entirety herein, an alternative design uses a nozzle carrier with an external seal, a seal sleeve with bypass slots, and a Belleville spring stack for a similar purpose. The dart 600 may be configured with this or other alternate designs but continue to use the key sections 510, 520, and 530 for engagement with dart catching sections 410, 420, and 430 to allow independent activation, deactivation, and modification of operating parameters of multiple downhole tools in a string.

Figure 13:
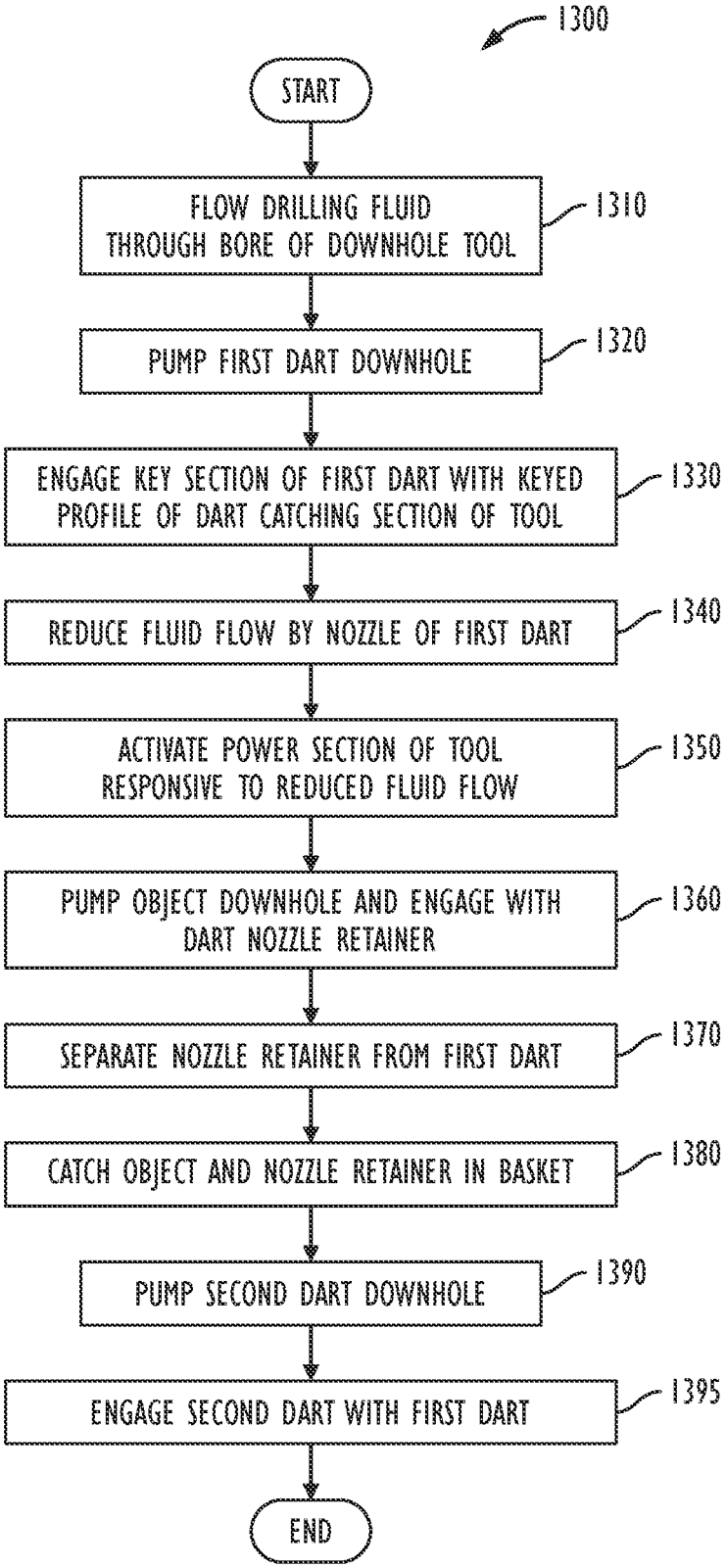
FIG. 13 is a flowchart illustrating a technique for activating and deactivating a downhole tool.

FIG. 13 is a flowchart 1300 illustrating a technique for activating and deactivating a downhole tool using a dart according to one embodiment. In block 1310 drilling fluid flows through the bore of a downhole tool such as the agitator tool 120 of FIG. 1. In block 1320, a first dart is dropped or pumped downhole. The first dart has a key section that is configured to engage with the dart-catching section of the downhole tool. The first dart may pass through other downhole tools uphole from the destination downhole tool that have different dart-catching sections with profiles that do not engage with the key section of the dart. In block 1330, the first dart reaches the downhole tool and the key section of the dart engages with the dart catching section of the downhole tool. In block 1340, the nozzle of the dart causes a diversion in the fluid flow through the bore of the downhole tool, diverting it into the power section 300, and in block 1350, the diverted fluid flow activates the downhole tool, as described above.

To deactivate the downhole tool, an object such as a ball or plug is pumped downhole in block 1360, which engages with the nozzle retainer of the first dart. In block 1370, increased pump pressure on the nozzle retainer causes the nozzle retainer to separate from the dart. The separated dart and the object are retained in block 1380 in the basket of the first dart. The downhole tool may then run deactivated for a significant amount of time, until the operator desires to reactivate the downhole tool.

A second dart may now be pumped downhole in block 1390, engaging with the first dart in block 1395. A nozzle in the second dart again diverts fluid flow, activating the downhole tool or modifying its operational parameters.

The actions identified in FIG. 13 are illustrative and by way of example only and actions may be combined or further separated, performed in different orders. Actions recited in FIG. 13 may be omitted and additional actions may be performed as desired. For example, in accordance with the techniques illustrated in FIGS. 15-18, additional actions may be performed using a second object to engage with the second dart, causing the nozzle of the second dart to separate and be caught in the basket of the first dart.

Although only a second dart is illustrated and described above, one of skill in the art would understand that additional darts and cycles of deactivating and reactivating the downhole tool may be employed.

The following examples pertain to further embodiments.

Example 1 is a downhole tool for inclusion in a drill string, comprising: a dart-catching section disposed on an uphole end of the downhole tool, comprising: a guide section forming a guide for receiving a dart when dropped from uphole; and a keyed profile, configured to engage with a corresponding key section of the dart, catching the dart, and configured to allow darts having a different key section to pass through the downhole tool; and a power section, coupled to the dart catching section, configured to power the downhole tool when activated by catching the dart in the dart catching section.

In Example 2 the subject matter of Example 1 optionally includes wherein the downhole tool is an agitator tool.

In Example 3 the subject matter of any of Examples 1-2 optionally includes wherein the power section of the downhole tool comprises: an outer housing forming a stator of a fluid-driven motor; and an inner mandrel forming a rotor of the fluid-driven motor that rotates relative to the outer housing to power the downhole tool.

Example 4 is a dart for use downhole, comprising: a key section disposed on an outer surface of the dart, comprising a sequence of keys for engaging a corresponding keyed profile on an inner surface of a downhole tool; a dart body, open for fluid flow through the dart; a nozzle retainer affixed in a bore of the dart body, wherein the nozzle retainer is separable from the dart body upon engagement with an object dropped downhole; a dart nozzle attached to the nozzle retainer configured for a predetermined amount of fluid flow diversion; and a basket section having openings for fluid flow through the dart, coupled to the dart body, wherein the basket section retains the nozzle retainer and dart nozzle upon separation of nozzle retainer from the dart body.

In Example 5 the subject matter of Example 4 optionally includes wherein the object is a ball.

In Example 6 the subject matter of Example 4 optionally includes wherein the object is a plug.

In Example 7 the subject matter of any of Examples 4-6 optionally includes wherein the key section is urged radially outward.

In Example 8 the subject matter of any of Examples 4-7 optionally includes wherein the dart passes through dart-catching sections of downhole tools with a different keyed profile.

In Example 9 the subject matter of any of Examples 4-8 optionally further comprises a shear pin for holding the nozzle retainer in place, the shear pin configured to shear at a predetermined pumping pressure, separating the nozzle retainer from the dart body.

In Example 10 the subject matter of any of Examples 4-9 optionally further comprises: a dart retrieval section configured for wireline retrieval uphole of the dart.

In Example 11 the subject matter of Example 4 optionally includes wherein the dart body is configured to capture a second dart dropped from uphole after the nozzle retainer has been separated from the dart body, and wherein the second dart contains a second nozzle that modifies fluid flow downhole for modifying an operating parameter of the downhole tool.

Example 12 is a method of controlling a first downhole tool, comprising: flowing drilling fluid through a bore of the first downhole tool; pumping downhole a first dart; engaging a key section of the first dart with a corresponding keyed profile of a dart catching section of the first downhole tool; diverting drilling fluid flow from the bore by a nozzle of the first dart; and activating a power section of the first downhole tool responsive to diverting drilling fluid flow.

In Example 13 the subject matter of Example 12 optionally includes wherein the first dart passes through a dart catching section of a second downhole tool having a different keyed profile.

In Example 14 the subject matter of any of Examples 12-13 optionally further comprises: pumping an object downhole for engaging with a nozzle retainer of the first dart; separating the nozzle retainer of the first dart engaged with the object under increased pumping pressure, deactivating the first downhole tool; and catching the object, the nozzle retainer, and nozzle in a basket section of the first dart.

In Example 15 the subject matter of Example 14 optionally includes wherein the object is a ball.

In Example 16 the subject matter of Example 14 optionally includes wherein the object is a plug.

In Example 17 the subject matter of any of Examples 12-16 optionally further comprises: pumping a second dart downhole, wherein the second dart contains a nozzle configured for a predetermined diversion of fluid flow through the second dart; and engaging the second dart with the first dart, further modifying fluid flow through the first dart.

In Example 18 the subject matter of any of Examples 12-17 optionally further comprises: retrieving the first dart with a wireline tool; and deactivating the power section of the downhole tool responsive to retrieving the first dart.

In Example 19 the subject matter of any of Examples 12-18 optionally further comprises: independently controlling a second downhole tool uphole of the first downhole tool having a dart catching section that engages with a different key section of a second dart.

In Example 20 the subject matter of Example 19 optionally further comprises: independently controlling a third downhole tool uphole of the second downhole tool having a dart catching section that engages with a different key section of a third dart.

The above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

We claim:

1. A dart for use downhole, comprising:

a key section disposed on an outer surface of the dart, comprising a sequence of keys for engaging a corresponding keyed profile on an inner surface of a downhole tool;

a dart body, open for fluid flow through the dart;

a nozzle retainer affixed in a bore of the dart body, wherein the nozzle retainer is separable from the dart body upon engagement with an object dropped downhole;

a dart nozzle attached to the nozzle retainer configured for a predetermined amount of fluid flow diversion; and a basket section having openings for fluid flow through the dart, coupled to the dart body, wherein the basket section retains the nozzle retainer and dart nozzle upon separation of nozzle retainer from the dart body, wherein the dart body is configured to capture a second dart dropped from uphole after the nozzle retainer has been separated from the dart body, and wherein the second dart contains a second nozzle that modifies fluid flow downhole for modifying an operating parameter of the downhole tool.

2. The dart of claim 1, wherein the object is a ball.

3. The dart of claim 1, wherein the object is a plug.

4. The dart of claim 1, wherein the key section is urged radially outward.

5. The dart of claim 1, wherein the dart passes through dart-catching sections of downhole tools with a different keyed profile.

6. The dart of claim 1, further comprising a shear pin for holding the nozzle retainer in place, the shear pin configured to shear at a predetermined pumping pressure, separating the nozzle retainer from the dart body.

7. The dart of claim 1, further comprising:

a dart retrieval section configured for wireline retrieval uphole of the dart.

8. A method of controlling a first downhole tool, comprising:

flowing drilling fluid through a bore of the first downhole tool;

pumping downhole a first dart;

engaging a key section of the first dart with a corresponding keyed profile of a dart catching section of the first downhole tool;

diverting drilling fluid flow from the bore by a nozzle of the first dart;

activating a power section of the first downhole tool responsive to diverting drilling fluid flow, pumping a second dart downhole, wherein the second dart contains a nozzle configured for a predetermined diversion of fluid flow through the second dart; and engaging the second dart with the first dart, further modifying fluid flow through the first dart.

9. The method of claim 8, wherein the first dart passes through a dart catching section of a second downhole tool having a different keyed profile.

10. The method of claim 8, further comprising:

pumping an object downhole for engaging with a nozzle retainer of the first dart;

separating the nozzle retainer of the first dart engaged with the object under increased pumping pressure, deactivating the first downhole tool; and catching the object, the nozzle retainer, and nozzle in a basket section of the first dart.

11. The method of claim 10, wherein the object is a ball.

12. The method of claim 10, wherein the object is a plug.

13. The method of claim 8, further comprising:

retrieving the first dart with a wireline tool; and deactivating the power section of the first downhole tool responsive to retrieving the first dart.

14. The method of claim 8, further comprising:

independently controlling a second downhole tool uphole of the first downhole tool having a dart catching section that engages with a different key section of a second dart.

15. The method of claim 14, further comprising:

independently controlling a third downhole tool uphole of the second downhole tool having a dart catching section that engages with a different key section of a third dart.

* * * * *